US007059949B1

(12) United States Patent
Elmufdi et al.

(10) Patent No.: US 7,059,949 B1
(45) Date of Patent: Jun. 13, 2006

(54) CMP PAD HAVING AN OVERLAPPING STEPPED GROOVE ARRANGEMENT

(75) Inventors: Carolina L. Elmufdi, Glen Mills, PA (US); Gregory P. Muldowney, Earleville, MD (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 11/012,396

(22) Filed: Dec. 14, 2004

(51) Int. Cl.
*B24D 11/00* (2006.01)

(52) U.S. Cl. ..... 451/527; 451/530

(58) Field of Classification Search ..... 451/526–528, 451/530, 533–539
See application file for complete search history.

(56) References Cited

U.S. PATENT DOCUMENTS 5,177,908 A 1/1993 Tuttle
5,645,469 A 7/1997 Burke et al.
5,650,039 A 7/1997 Talieh
5,990,012 A 11/1999 Robinson et al.
6,089,966 A * 7/2000 Arai et al. ..... 451/533
6,120,366 A 9/2000 Lin et al.
6,241,596 B1 6/2001 Osterheld et al.
6,843,711 B1 1/2005 Muldowney
2002/0068516 A1 6/2002 Chen et al.
2002/0083577 A1 * 7/2002 Suzuki ..... 29/603.16

FOREIGN PATENT DOCUMENTS

EP 1 114 697 A2 7/2001

* cited by examiner

*Primary Examiner*—Dung Van Nguyen
(74) *Attorney, Agent, or Firm*—Blake T. Biederman

(57) ABSTRACT

A polishing pad (104, 300) having an annular polishing track (152, 320) and a plurality of groups (160, 308) of grooves (112, 304) repeated circumferentially about the rotational center (128) of the pad. The plurality of grooves in each group are arranged along a trajectory (164, 312) in an offset and overlapping manner so as to provide a plurality of overlapping steps (172, 316) within the annular polishing track. The groups may be arranged in spaced-apart or nested relation with one another.

10 Claims, 3 Drawing Sheets

CMP PAD HAVING AN OVERLAPPING STEPPED GROOVE ARRANGEMENT

BACKGROUND OF THE INVENTION

The present invention generally relates to the field of chemical mechanical polishing (CMP). In particular, the present invention is directed to a CMP pad having an overlapping stepped groove arrangement.

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize workpieces such as semiconductor wafers. In conventional CMP, a wafer carrier, or polishing head, is mounted on a carrier assembly. The polishing head holds the wafer and positions the wafer in contact with a polishing layer of a polishing pad within a CMP apparatus. The carrier assembly provides a controllable pressure between the wafer and polishing pad. Simultaneously therewith, a slurry, or other polishing medium, is flowed onto the polishing pad and into the gap between the wafer and polishing layer. To effect polishing, the polishing pad and wafer are moved, typically rotated, relative to one another. The wafer surface is polished and made planar by chemical and mechanical action of the polishing layer and polishing medium on the surface. As the polishing pad rotates beneath the wafer, the wafer sweeps out a typically annular polishing track, or polishing region, wherein the wafer surface directly confronts the polishing layer.

Important considerations in designing a polishing layer include the distribution of polishing medium across the face of the polishing layer, the flow of fresh polishing medium into the polishing track, the flow of used polishing medium from the polishing track and the amount of polishing medium that flows through the polishing zone essentially unutilized, among others. One way to address these considerations is to provide the polishing layer with grooves. Over the years, quite a few different groove patterns and configurations have been implemented. Conventional groove patterns include radial, concentric-circular, Cartesian-grid and spiral, among others. Conventional groove configurations include configurations wherein the depth of all the grooves are uniform among all grooves and configurations wherein the depth of the grooves varies from one groove to another.

It is generally acknowledged among CMP practitioners that certain groove patterns result in higher slurry consumption than others to achieve comparable material removal rates. Circular grooves, which do not connect to the peripheral edge of the polishing layer, tend to consume less slurry than radial grooves, which provide the shortest possible path for slurry to reach the pad perimeter under the forces resulting from the rotation of the pad. Cartesian grids of grooves, which provide paths of various lengths to the peripheral edge of the polishing layer, hold an intermediate position.

Various groove patterns have been disclosed in the prior art that attempt to reduce slurry consumption and maximize slurry retention time on the polishing layer. For example, U.S. Pat. No. 6,241,596 to Osterheld et al. discloses a rotational-type polishing pad having grooves defining zigzag channels that generally radiate outward from the center of the pad. In one embodiment, the Osterheld et al. pad includes a rectangular "x-y" grid of grooves. The zigzag channels are defined by blocking selected ones of the intersections between the x- and y-direction grooves, while leaving other intersections unblocked. In another embodiment, the Osterheld et al. pad includes a plurality of discrete, generally radial zigzag grooves. Generally, the zigzag channels defined within the x-y grid of grooves or by the discrete zigzag grooves inhibit the flow of slurry through the corresponding grooves, at least relative to an unobstructed rectangular x-y grid of grooves and straight radial grooves. Another prior art groove pattern that has been described as providing increased slurry retention time is a spiral groove pattern that is assumed to push slurry toward the center of the polishing layer under the force of pad rotation.

Research and modeling of CMP to date, including state-of-the-art computational fluid dynamics simulations, have revealed that in networks of grooves having fixed or gradually changing depth, a significant amount of polishing slurry may not contact the wafer because the slurry in the deepest portion of each groove flows under the wafer without contact. While grooves must be provided with a minimum depth to reliably convey slurry as the surface of the polishing layer wears down, any excess depth will result in some of the slurry provided to polishing layer not being utilized, since in conventional polishing layers an unbroken flow path exists beneath the workpiece wherein the slurry flows without participating in polishing. Accordingly, there is a need for a polishing layer having grooves arranged in a manner that reduces the amount of underutilization of slurry provided to the polishing layer and, consequently, reduces the waste of slurry.

STATEMENT OF THE INVENTION

In one aspect of the invention, a polishing pad, comprising: a) a polishing layer configured to polish a surface of at least one of a magnetic, optical or semiconductor substrate in the presence of a polishing medium, the polishing layer including a rotational axis and an annular polishing track concentric with the rotational axis; and b) a plurality of grooves formed in the polishing layer and arranged into a plurality of groups each along a trajectory that extends through the annular polishing track, wherein ones of the plurality of grooves within each group form an overlapping stepped pattern within the annular polishing track.

In another aspect of the invention, polishing pad, comprising: a) a polishing layer configured to polish a surface of at least one of a magnetic, optical or semiconductor substrate in the presence of a polishing medium, the polishing layer including a rotational axis and an annular polishing track concentric with the rotational axis; and b) a plurality of grooves formed in the polishing layer and arranged into a plurality of groups each along a trajectory that extends through the annular polishing track, wherein ones of the plurality of grooves within each group form at least one overlapping step within the annular polishing track.

DETAILED DESCRIPTION OF THE INVENTION

Figure 1:
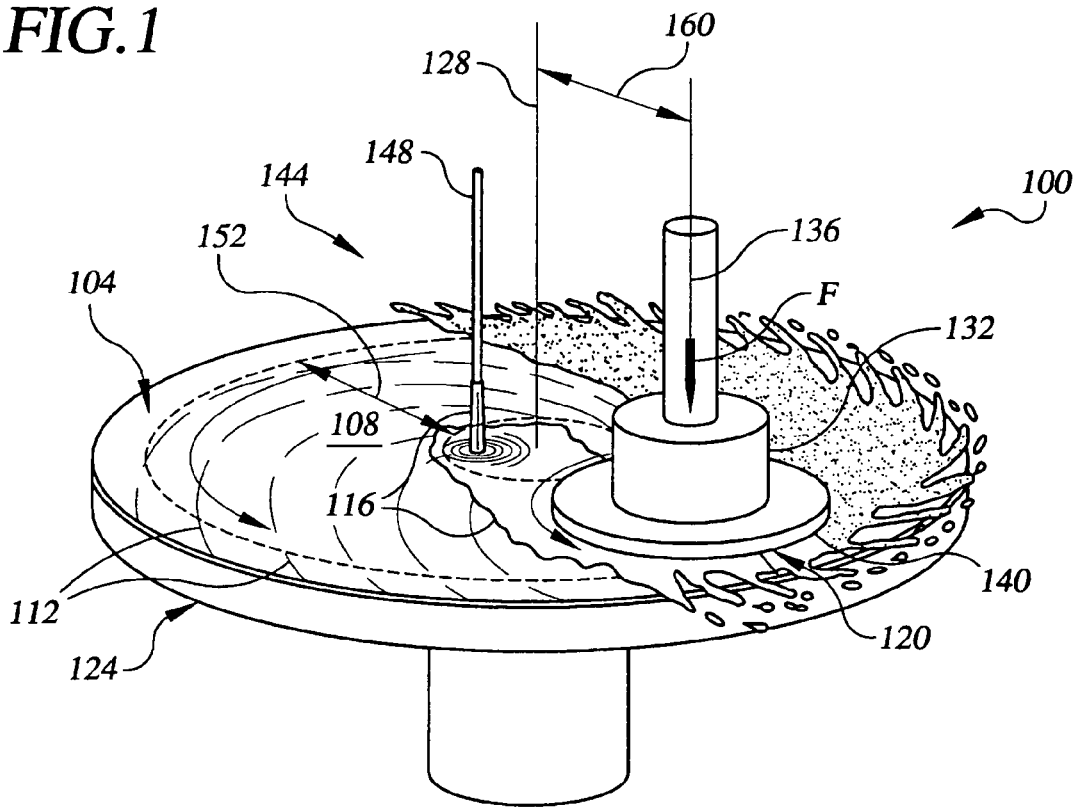
FIG. 1 is a partial perspective view of a chemical mechanical polishing (CMP) system of the present invention.

Referring now to the drawings, FIG. 1 shows in accordance with the present invention a chemical mechanical polishing (CMP) system, which is generally denoted by the numeral 100. CMP system 100 includes a polishing pad 104 having a polishing layer 108 that includes a plurality of grooves 112 arranged and configured for improving the utilization of a polishing medium 116 applied to the polishing pad during polishing of a semiconductor wafer 120 or other workpiece, such as glass, silicon wafers and magnetic information storage disks, among others. For convenience, the term "wafer" is used in the description below. However, those skilled in the art will appreciate that workpieces other than wafers are within the scope of the present invention. Polishing pad 104 and its unique features are described in detail below.

CMP system 100 may include a polishing platen 124 rotatable about an axis 128 by a platen driver (not shown). Platen 124 may have an upper surface on which polishing pad 104 is mounted. A wafer carrier 132 rotatable about an axis 136 may be supported above polishing layer 108. Wafer carrier 132 may have a lower surface that engages wafer 120. Wafer 120 has a surface 140 that confronts polishing layer 108 and is planarized during polishing. Wafer carrier 132 may be supported by a carrier support assembly (not shown) adapted to rotate wafer 120 and provide a downward force F to press wafer surface 140 against polishing layer 108 so that a desired pressure exists between the wafer surface and the polishing layer during polishing.

CMP system 100 may also include a supply system 144 for supplying polishing medium 116 to polishing layer 108. Supply system 144 may include a reservoir (not shown), e.g., a temperature controlled reservoir, that holds polishing medium 116. A conduit 148 may carry polishing medium 116 from the reservoir to a location adjacent polishing pad 104 where the polishing medium is dispensed onto polishing layer 108. A flow control valve (not shown) may be used to control the dispensing of polishing medium 116 onto pad 104. During the polishing operation, the platen driver rotates platen 124 and polishing pad 104 and the supply system 144 is activated to dispense polishing medium 116 onto the rotating polishing pad. Polishing medium 116 spreads out over polishing layer 108 due to the rotation of polishing pad 104, including the gap between wafer 120 and polishing pad 104. The wafer carrier 132 may be rotated at a selected speed, e.g., 0 rpm to 150 rpm, so that wafer surface 140 moves relative to the polishing layer 108. The wafer carrier 132 may also be controlled to provide a downward force F so as to induce a desired pressure, e.g., 0 psi to 15 psi (0 kPa to 103 kPa), between wafer 120 and polishing pad 104. Polishing platen 124 is typically rotated at a speed of 0 to 150 rpm. As polishing pad 104 is rotated beneath wafer 120, surface 140 of the wafer sweeps out a typically annular wafer track, or polishing track 152 on polishing layer 108.

It is noted that under certain circumstances polishing track 152 may not be strictly annular. For example, if surface 140 of wafer 120 is longer in one dimension than another and the wafer and polishing pad 104 are rotated at particular speeds such that these dimensions are always oriented the same way at the same locations on polishing layer 108, polishing track 152 would be generally annular, but have a width that varies from the longer dimension to the shorter dimension. A similar effect would occur at certain rotational speeds if surface 140 of wafer 120 were bi-axially symmetric, as with a circular or square shape, but the wafer is mounted off-center relative to the rotational center of that surface. Yet another example of when polishing track 152 would not be entirely annular is when wafer 120 is oscillated in a plane parallel to polishing layer 108 and polishing pad 104 is rotated at a speed such that the location of the wafer due to the oscillation relative to the polishing layer is the same on each revolution of the pad. In all of these cases, which are typically exceptional, polishing track 152 is still annular in nature, such that they are considered to fall within the coverage of the term "annular" as this term is used in the appended claims.

Figure 2A:
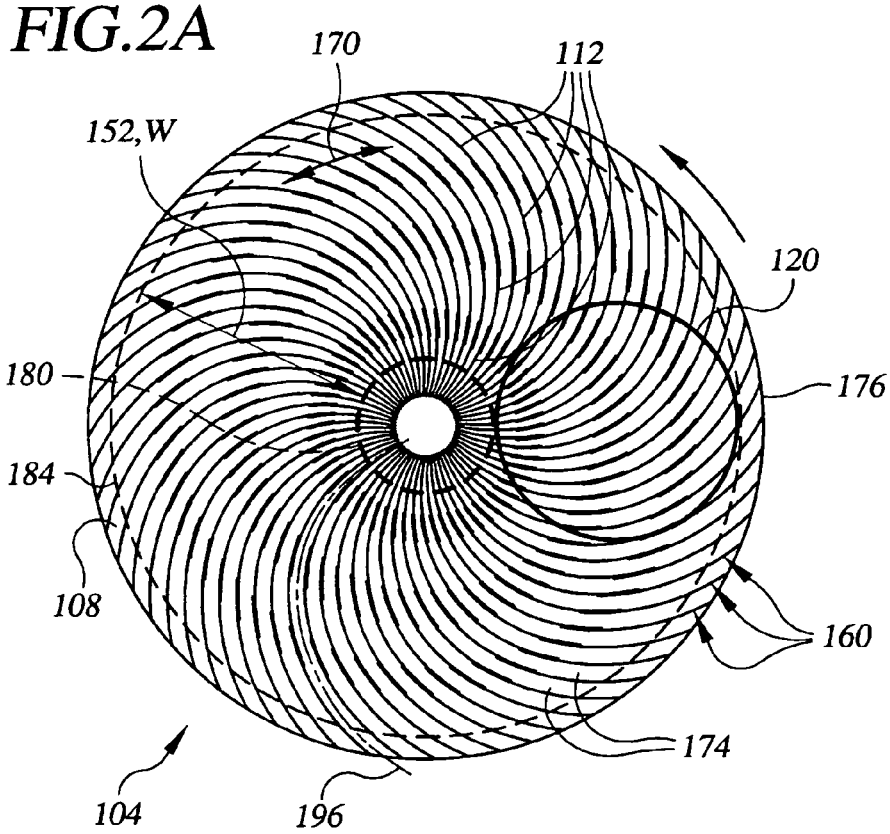
FIG. 2A is a plan view of the polishing pad of FIG. 1 having a plurality of overlapping stepped grooves arranged in groups that are spaced from one another in a circumferential direction relative to the pad.
Figure 2B:
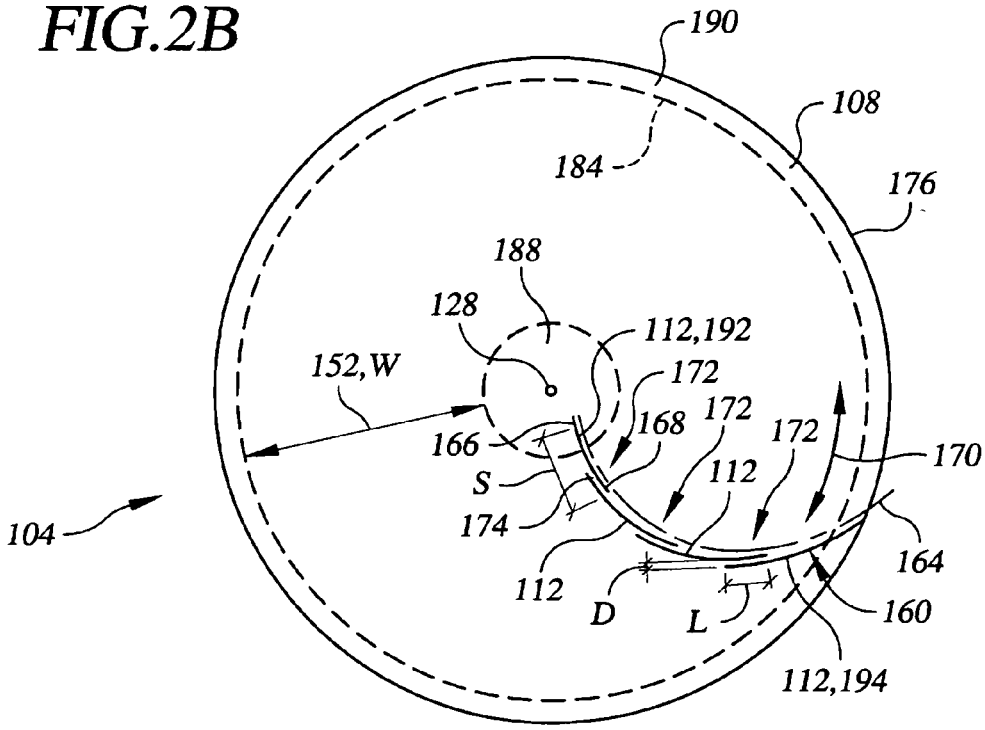
FIG. 2B is a plan view of the polishing pad of FIG. 2A illustrating one of the spaced apart groups of grooves.

FIGS. 2A and 2B illustrate polishing pad 104 of FIG. 1 in more detail than FIG. 1. Referring to both FIGS. 2A and 2B, grooves 112 are generally arranged into a plurality of groups 160 that are distributed in a generally radial manner around rotational axis 128 of polishing pad 104 and are preferably, but not necessarily, identical to one another. Each group 160 may contain a number N of grooves 112, wherein $N \geqq 2$. In the present example, each group 160 contains four grooves 112, i.e., N=4. Grooves 112 within each group 160 are arranged and configured so as to define what may be described as an "overlapping stepped arrangement" that generally lies along a trajectory 164. Each groove 112 within a group 160 may be considered to have a radially inward end 166 and a radially outward end 168. Consequently, the "overlapping" portion of the foregoing description refers to the radially inward and radially outward ends 166, 168 of immediately adjacent grooves 112 being spaced from one another in a circumferential direction 170 relative to polishing pad 104 along a nonzero overlap length L. The "stepped" portion of the foregoing description refers to adjacent ones of overlapping grooves 112 in each group 160 being spaced, or offset, from one another by a distance D so as to generally form a discontinuous polishing medium flow path along trajectory 164. When traversing each trajectory 164 from one of its ends to the other, each offset encountered generally has the appearance of a stair step. Therefore, each of these offsets may be considered to define a step and, more particularly, an overlapping step 172 having overlap length L.

As mentioned above, grooves 112 in each group 160 may be provided in any number $N \geqq 2$. Consequently, each group 160 will have N−1 overlapping steps 172. For the reasons discussed immediately below, all overlapping steps 172 should be located within polishing track 152. Generally, a primary concept underlying groups 160 is to provide a segmented pathway for a polishing medium to flow within polishing track 152. When a polishing medium is present within one of grooves 112, it typically flows within that groove under the influence of centrifugal force as polishing pad 104 is rotated during polishing. However, the polishing medium tends to not flow from one groove 112 to an adjacent groove across the land region 174 therebetween under the influence of this centrifugal force. Rather, the polishing medium is generally moved from one groove 112 to a next adjacent groove across land region 174 primarily by the interaction of wafer 120 with the polishing medium on polishing layer 108 as the wafer is rotated, or rotated and oscillated, in confrontation with polishing pad 104.

By providing groups 160 of discontinuous grooves 112, the polishing medium can be utilized more efficiently than in conventional polishing pads (not shown) having continuous grooves extending through their polishing tracks. Generally, this is so, because the polishing medium advances toward the peripheral edge 176 of polishing pad 104 from one groove 112 to another groove 112 substantially only when wafer 120 is present to move the polishing medium across the land regions 174. This is in contrast to the typical situation with continuous grooves (not shown) in which the polishing medium advances toward the peripheral edge of the polishing pad even when the wafer is not present simply due to the rotation of the polishing pad.

When each group 160 has three or more grooves 112 and, correspondingly, two or more overlapping steps 172 are located within polishing track 152, each of a number N−2 of the grooves will typically have a straight-line end-to-end distance S (i.e., distance along a straight line connecting endpoints 166, 168 of the groove under consideration) less than the width W of polishing track 152. In exemplary polishing pad 104, the four grooves 112 in each group 160 provide three overlapping steps 172 located entirely within polishing track 152. Consequently, two of the four grooves 112 in each group 160 have straight-line distances S shorter than width W of polishing track 152. In fact, in this example, all four grooves 112 within each group 160 have straight-line distances S shorter than width W. It is noted that the relationship S<W will not hold true for every design. For example, for N=3 with two overlapping steps 172 within polishing track 152, straight-line distance S may be equal to or greater than width W, particularly when trajectory 164 has a relatively large circumferential component within the polishing track.

Polishing track 152 will typically have a generally circular inner boundary 180 spaced from rotational axis 128 of polishing pad 104 and a generally circular outer boundary 184 proximate to, but spaced from peripheral edge 176 of the pad. Inner boundary 180 typically, but not necessarily, defines a central region 188 of polishing layer 108. Likewise, outer boundary 184 and peripheral edge 176 typically define a peripheral region 190. It is noted that one, the other, or both, of central region 188 and peripheral region 190 may not be present. Central region 188 would not be present if inner boundary 180 were coincident with rotational axis 128 of polishing pad 104 or the rotational axis were contained in polishing track 152. Peripheral region 190 would not be present if outer boundary 184 were coincident with peripheral edge 176.

In a CMP system that utilizes polishing pad 104 having central region 188 and that provides a polishing medium to the pad in the central region, such as CMP system 100 of FIG. 1, each group 160 of grooves 112 may include a radially innermost groove 192 that extends from the central region into polishing track 152. In this manner, grooves 192 can assist in moving the polishing medium from central region 188 into polishing track 152 during polishing. As mentioned above, the polishing medium will tend to flow within grooves 112, including grooves 192, even when wafer 120 is not present. When grooves 192 are largely radial, the centrifugal forces caused by rotating polishing pad 104 at a constant speed will tend to cause the polishing medium within these grooves to flow toward peripheral edge 176 of the pad.

When polishing pad 104 includes peripheral region 190, each group 160 of grooves 112 may contain a radially outermost groove 194 that is present in both polishing track 152 and the peripheral region. Depending on their orientation relative to the rotational direction of polishing pad 104, grooves 194 tend to assist in the transport of the polishing medium out of polishing track 152. Some, none, or all of radially outermost grooves 194 may extend to peripheral edge 176, depending upon a particular design. Extending outermost grooves 194 to peripheral edge 176 tends to move a polishing medium out of peripheral region 190 and off of polishing pad 104 at a rate higher than would occur if these grooves were terminated short of the peripheral edge. For certain orientations, this is so due to the tendency of the polishing medium to flow within grooves 194 under the influence of the rotation of polishing pad 104.

Figure 3A:
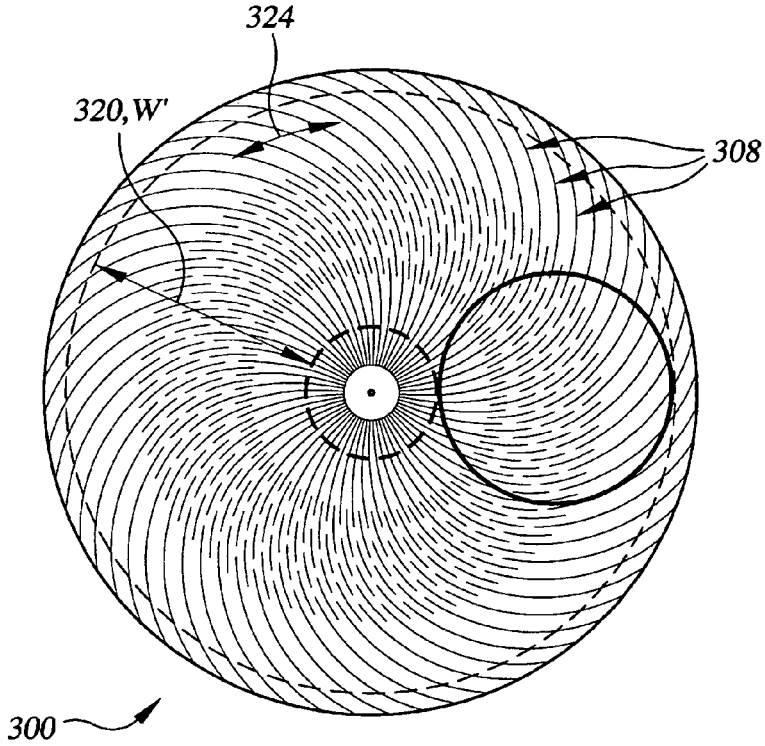
FIG. 3A is a plan view of an alternative polishing pad of the present invention having a plurality of overlapping stepped grooves arranged in groups that are nested with one another in a circumferential direction relative to the pad.

Trajectory 164 of each group 160 may generally have any shape desired, such as the arcuate shape shown, any arcuate shape having a greater or lesser curvature than the curvature shown or a curvature in the opposite direction from the direction shown, straight, either in a radial direction or angled thereto, or a wavy or zigzag shape, among others. Groups 160 may be spaced from one another in circumferential direction 170 as shown or, alternatively, may be nested with one another as illustrated in FIG. 3A as described below. Generally, one group 160 is "spaced-apart" relative to an immediately adjacent group if an intermediate line 196 having the same character as trajectory 164 can be drawn midway between the trajectories of the two groups and all grooves 112 of one group lie on one side of the intermediate line and all grooves of the other group lie on the other side of the intermediate line.

Figure 3B:
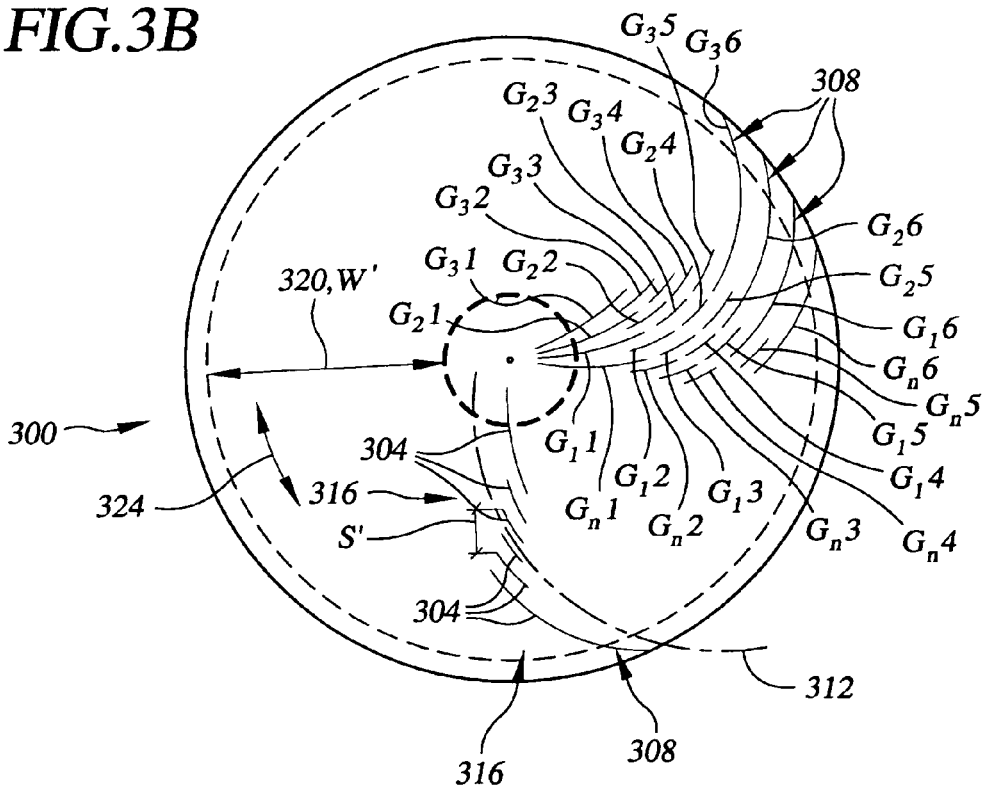
FIG. 3B is a plan view of the polishing pad of FIG. 3A illustrating one of the nested groups of grooves and the nesting of the groups.

FIGS. 3A and 3B illustrate an alternative polishing pad 300 of the present invention that may be used with a CMP system, such as CMP system 100 of FIG. 1. As best seen in FIG. 3B, a basic construct of polishing pad 300 is the arrangement of grooves 304 into a plurality of overlapping stepped groups 308 generally parallel to trajectories 312 in a manner virtually identical to the manner grooves 112 of polishing pad 104 of FIGS. 2A and 2B are arranged in groups 160 along corresponding trajectories 164. For a detailed description of the arrangement of grooves 304 within each group 308 of FIGS. 3A and 3B, the foregoing description of the arrangement of grooves 112 with each group 160 of FIGS. 2A and 2B may be used by analogy. In exemplary polishing pad 300 of FIGS. 3A and 3B, each group 308 contains six grooves 304 that provide five overlapping steps 316 generally parallel to trajectory 312 within annular polishing region 320. The overlapping stepped arrangement of grooves 304 provides functionality similar to the functionality of the groove arrangement described above in connection with FIGS. 2A and 2B. Like groups 160 of FIGS. 2A and 2B, groups 308 of FIGS. 3A and 3B may contain any number N of grooves 304 and a corresponding number N−1 of overlapping steps 316. Likewise, trajectories 312 of groups 308 may have any of the shapes described above relative to the trajectories 164 of FIG. 2B. Also, at least the N−2 grooves 304 contained entirely within polishing track 320 may each have a straight-line distance S' less than width W' of polishing track 320.

Whereas groups 160 of grooves 112 in FIG. 2A are considered to be spaced-apart from immediately adjacent groups, groups 308 of FIG. 3A are considered to be nested with adjacent groups. The nesting of groups 308 is best seen in connection with groups $G_1$, $G_2$, $G_3$ and $G_n$ of FIG. 3B that are particularly enumerated as such for convenience of illustration. Group $G_1$ contains six grooves $G_1$1, $G_1$2, $G_1$3, $G_1$4, $G_1$5, $G_1$6. Similarly, groups $G_2$ and $G_3$ contains grooves $G_2$1, $G_2$2, $G_2$3, $G_2$4, $G_2$5, $G_2$6 and grooves $G_3$1, $G_3$2, $G_3$3, $G_3$4, $G_3$5, $G_3$6, respectively. In a broad sense, the "nesting" of adjacent groups 308 means that an intermediate line (not shown, but similar to intermediate line 196 of FIG. 2A) having the same character as trajectories 312 that lies midway between two adjacent trajectories does not divide one group from another. Rather, grooves 304 from each of the two adjacent groups 308, and perhaps even grooves from other groups, lie on both sides of the intermediate line. In a particular implementation of nested groups 308, certain ones of grooves 304 from one group are located so that they align with certain grooves in other groups. This is shown in FIG. 3A and particularly illustrated in FIG. 3B in connection with groups $G_1$, $G_2$, $G_3$ and $G_n$. That said, it is noted that nesting does not necessarily require that grooves 304 of group 308 align with any of the grooves of another group.

Referring particularly to FIG. 3B, it is seen that when group $G_2$ is nested with group $G_1$, groove $G_{23}$ of group $G_2$ aligns with groove $G_1$1 of group $G_1$. Similarly, groove $G_2$4 of group $G_2$ aligns with groove $G_1$2 of group $G_1$. Then, when group $G_3$ is nested with groups $G_2$, and $G_1$, groove $G_3$6 of group $G_3$ aligns with grooves $G_2$4 and $G_1$2 of groups $G_2$ and $G_1$, respectively. Similarly, groove $G_3$5 of group $G_3$ aligns with grooves $G_2$3 and $G_1$1 of groups $G_2$ and $G_1$, respectively. This nesting progresses in circumferential direction 324 until group $G_n$ ultimately nests with group $G_1$ when groove $G_n$1 aligns with groove $G_1$3, groove $G_n$2 aligns with groove $G_1$4, groove $G_n$3 aligns with groove $G_1$5 and groove $G_n$4 aligns with groove $G_1$6. The nesting provided by the arrangement of grooves $G_n$1–6 shown in FIG. 3B enhances slurry movement under the wafer by creating multiple series and parallel paths for slurry to migrate from one groove to an adjacent groove, allowing the slurry to advance across land areas both along a stepped path provided by one group of grooves and along the smooth segmented path provided collectively by the ones of the grooves in adjacent nested groups that are aligned with one another.

The invention claimed is:

1. A polishing pad, comprising:

a) a polishing layer configured to polish a surface of at least one of a magnetic, optical or semiconductor substrate in the presence of a polishing medium, the polishing layer including a rotational axis and an annular polishing track concentric with the rotational axis; and b) a plurality of grooves formed in the polishing layer and arranged into a plurality of groups of at least three grooves each along a trajectory that extends through the annular polishing track, wherein the at least three grooves of the plurality of grooves within each group form an overlapping stepped pattern of at least two overlapping steps within the annular polishing truck for forming a discontinuous flow path along the trajectory.

2. The polishing pad according to claim 1, wherein the plurality of groups are spaced from one another in a circumferential direction about the rotational axis.

3. The polishing pad according to claim 1, wherein the plurality of groups are nested with one another in a circumferential direction about the rotational axis.

4. The polishing pad according to claim 1, wherein the annular polishing track has a width and each groove in each of the plurality of grooves has a length shorter than the width of the annular polishing track.

5. The polishing pad according to claim 1, wherein the trajectory of each of the plurality of groups is arcuate.

6. The polishing pad according to claim 5, wherein the polishing pad has a design rotational direction and the trajectory of each of the plurality of groups is curved in the design rotational direction.

7. A polishing pad, comprising:

a) a polishing layer configured to polish a surface of at least one of a magnetic, optical or semiconductor substrate in the presence of a polishing medium, the polishing layer including a rotational axis and an annular polishing track concentric with the rotational axis; and b) a plurality of grooves formed in the polishing layer and arranged into a plurality of groups of at least three grooves each along a trajectory that extends through the annular polishing track, wherein the at least three grooves ($N \geqq 3$) of the plurality of grooves within each group form an overlapping stepped pattern of N−1 steps within the annular polishing track for forming a discontinuous flow path along the trajectory.

8. The polishing pad of claim 7, wherein ones of the plurality of grooves within each group form at least two overlapping steps within the annular polishing track.

9. The polishing pad of claim 7, wherein the pad further comprises a peripheral edge and the annular polishing track includes an inner circular boundary, the polishing layer further including a central region defined by the inner circular boundary of the annular polishing track, and a peripheral region located between the annular polishing track and the peripheral edge of the pad, each of the plurality of groups including an inner groove present only in the central region and the annular polishing track and an outer groove present only in the annular polishing track and the peripheral region.

10. The polishing pad of claim 7, wherein the annular polishing track has a width and each groove in each of the plurality of grooves has a length shorter than the width of the annular polishing track.

* * * * *